US008816227B2

(12) United States Patent
He et al.

(10) Patent No.: US 8,816,227 B2
(45) Date of Patent: Aug. 26, 2014

(54) DUST-PROOF KEYBOARD

(75) Inventors: Jing He, Guangzhou (CN); Xiaodian Chen, Guangzhou (CN); Dong Wei, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 214 days.

(21) Appl. No.: 13/321,800

(22) PCT Filed: Mar. 24, 2010

(86) PCT No.: PCT/CN2010/071250

§ 371 (c)(1),
(2), (4) Date: Jan. 4, 2012

(87) PCT Pub. No.: WO2010/142159

PCT Pub. Date: Dec. 16, 2010

(65) Prior Publication Data

US 2012/0097513 A1 Apr. 26, 2012

(30) Foreign Application Priority Data

Jun. 9, 2009 (CN) ..... 2009 1 0040104

(51) Int. Cl.
*H01H 9/04* (2006.01)
*H01H 13/705* (2006.01)
*H01H 13/86* (2006.01)

(52) U.S. Cl.
CPC ..... *H01H 13/705* (2013.01); *H01H 2223/0002* (2013.01); *H01H 2223/004* (2013.01); *H01H 13/86* (2013.01)
USPC ..... 200/302.1; 200/5 A

(58) Field of Classification Search
USPC ..... 200/302.2, 302.1
See application file for complete search history.

(56) References Cited

U.S. PATENT DOCUMENTS 3,996,428 A 12/1976 Buan et al.
5,300,742 A * 4/1994 Huang ..... 200/302.2

(Continued)

FOREIGN PATENT DOCUMENTS

CN 2807703 Y 8/2006
CN 201017797 Y 2/2008
CN 101576774 A 11/2009
GB 2130016 A 5/1984

OTHER PUBLICATIONS

International Search Report dated Jul. 8, 2010 from corresponding International Application No. PCT/CN2010/071250.

(Continued)

*Primary Examiner* — Renee Luebke
*Assistant Examiner* — Ahmed Saeed
(74) *Attorney, Agent, or Firm* — Wolf, Greenfield & Sacks, P.C.

(57) ABSTRACT

A dust-proof keyboard includes a keyboard main body and a plurality of keyboard keys (4) buckled on the keyboard main body. The keyboard keys (4) include key caps (41) and contact blocks (42) connected with one side of the key caps (41). The keyboard main body includes a silicone layer (3), a binding layer (5), a circuit board (7) and elastic sheets (8) corresponding to the keyboard keys (4). The elastic sheets (8) are located between the binding layer (5) and the circuit board (7), and the silicone layer (3) is located between the binding layer (5) and the keyboard keys (4). The silicone layer (3) is provided with a plurality of dust-proof rings (31) corresponding to the elastic sheets (8). The dust-proof rings (31) are hollow cylinders, at least one end of which is open, and the open ends are rightly placed opposite to the contact blocks (42). The dust-proof rings (31) do not influence a normal contact between the contact blocks (42) and the circuit board (7) while separating the working surfaces (D) of the contact blocks (42) from the environment, thereby playing a dust-proof and water-proof role, and enabling the operation of the keys of the dust-proof keyboard to be normal.

14 Claims, 5 Drawing Sheets

(56) References Cited

U.S. PATENT DOCUMENTS

| | | | | |
|---|---|---|---|---|
| 5,821,482 | A | 10/1998 | Ootani et al. | |
| 6,273,623 | B1 | 8/2001 | Chao | |
| 7,262,379 | B2 * | 8/2007 | Nishimura et al. | 200/314 |
| 2003/0179540 | A1 | 9/2003 | Suda | |

OTHER PUBLICATIONS

Extended European Search Report dated Feb. 7, 2014 from corresponding European Application No. 10785672.

* cited by examiner

DUST-PROOF KEYBOARD

This application claims priority to Chinese Patent Application No. 200910040104.4, filed on Jun. 9, 2009 with the Chinese Patent Office, entitled "Dustproof Keyboard", the entire disclosure of which is incorporated herein by reference.

FIELD OF THE INVENTION

The present invention relates to the field of electronic device, in particular, to a dustproof keyboard.

BACKGROUND OF THE INVENTION

Computers have become a tool indispensable to various industries in the contemporary society with prompt information exchange. The computer's kinds and patterns are also changed quickly as its function is increasingly improved. However, no matter what pattern the computer is, its interface provided for communication with the user is still dominated by a keyboard. An important manner with which the user communicates with the computer via the keyboard is to repeatedly and frequently press the key, hence, how to increase the durability of the keyboard keys and the comfort level during their operation becomes one of important problems to be dealt with by large manufacturers.

FIG. 1 is a schematic perspective exploded view of a keyboard in the prior art. As shown in FIG. 1, the keyboard includes a keyboard panel 201, a keyboard liner 202, keyboard keys 204 positioned between the keyboard panel 201 and the keyboard liner 202, a waterproof silica gel 203, a binding layer 205, a limiting layer 206, elastic pieces 208 fixedly positioned between the binding layer 205 and the limiting layer 206, a circuit board 207 and a keyboard soleplate 209. The keyboard panel 201, the keyboard liner 202, the waterproof silica gel 203, the binding layer 205, the limiting layer 206, the circuit board 207 and the keyboard soleplate 209 are successively superposed with each other and assembled together via welding type screws 201*b* on the keyboard panel 201. Finally, all of the above mentioned components are compressed and secured by fixing nuts on the keyboard soleplate 209.

In the above keyboard, square slots 201*a* are provided within the keyboard panel 201 and the keyboard keys 204 are placed within the square slots 201*a*. Correspondingly, the keyboard liner 202 is also provided with square slots 202*a*. A reasonable distance is left between the keyboard keys 204 and the keyboard panel 201/the keyboard liner 202, such that the keyboard keys 204 can have spaces for downwards movement. When the keyboard key 204 is pressed, the elastic piece 208 is deformed to contact a golden finger on the circuit board 207 so as to achieve the conduction, thereby completing a normal key pressing process. The waterproof silica gel 203 provides the dustproof and waterproof function, and the binding layer 205 and the limiting layer 206 function to fix the elastic pieces 208.

The prior art keyboard has at least the following problems.

As shown in FIG. 1*b*, there is no a dustproof ring design on the waterproof silica gel 203, thus, the waterproof silica gel 203 only performs the dustproof function for the keyboard liner 202 and the circuit board 207 positioned below the waterproof silica gel. When the keyboard key 204 is pressed and moved down, the dust can enter through a gap between the keyboard panel 201 and the keyboard key 204. Once the dust accumulates on surface B, it may result in the phenomenon that the key is blocked and out of control, thereby shortening the service life of the keyboard.

Thus, there is a need for a dustproof keyboard to overcome the above defects.

SUMMARY OF THE INVENTION

An object of the invention is to provide a dustproof keyboard which can avoid the key blockage and can perform the dustproof function.

In order to achieve the above object, according to the invention a dustproof keyboard is provided including: a keyboard main body and a plurality of keyboard keys disposed at the keyboard main body so as to be caught therein, the keyboard key comprising a keycap and a contact block connected to a side of the keycap, the keyboard main body comprising a binding layer, a silica gel layer disposed between the binding layer and the keyboard key, a circuit board, and elastic pieces corresponding to the keyboard keys and disposed between the binding layer and the circuit board. In correspondence to the elastic pieces, a plurality of dustproof rings are provided on the silica gel layer, each of the dustproof rings being a hollow post with at least one end being opened, and the opened end thereof being exactly towards the contact block. The dustproof ring does not affect the normal contact between the contact block and the circuit board while separating the working surface of the contact block from the outside. Thus, the dustproof ring performs the dustproof and waterproof function, and maintains the normal key operation in the dustproof keyboard, thereby increasing the service life of the keyboard.

The dustproof ring is a ring-like post, thus has an esthetic appearance and is easy to be produced.

The keycap comprises a keycap cover, a keycap sidewall and a keycap base provided with a through hole in a middle portion thereof, the keycap base and the keycap cover being connected to opposite sides of the keycap sidewall respectively, and the contact block being located within a cavity formed by the keycap cover and the keycap sidewall.

The contact block is a cylinder, an inner diameter of the dustproof ring being 1.3 times as great as an outer diameter of the contact block, and an outer diameter thereof being smaller than a radius of an inscribed circle of the section of the keycap sidewall. Thus, the contact block freely extends into or retracts out of the dustproof ring within a proper space so as to perform a normal key input operation.

A height of the dustproof ring is greater than a height of the elastic piece and smaller than a length of the contact block. Accordingly, during the key operation, the working surface of the contact block can be in normal contact with the elastic piece.

An inner side wall of the keycap base is inclined outwards in a direction in which the keyboard key is pressed straight. When the keyboard key is pressed, the inclined configuration may guide the dust to both sides of the cavity, thereby preventing the dust from accumulating on the elastic piece below the keyboard key.

An included angle between the inner side wall of the keycap base and the straight pressing direction of the keyboard key is twice as great as a maximum deviation angle of the key.

A junction between at least two adjacent surfaces of the keycap base is in arc shape. The arc configuration can function to guide the falling dust.

A radius of the arc is smaller than 0.5 mm.

The invention will become clearer from the following description with reference to the attached drawings for explaining the embodiments thereof.

DETAILED DESCRIPTION

A clear and complete description of the technical solutions in the embodiments of the invention will now be made with reference to the attached drawings therein. Obviously, the embodiments described herein are not all of the embodiments of the invention, but only a part thereof. Based on the embodiments of the invention, all further embodiments that can be achieved by the skilled in the art without inventive efforts will fall within the protective scope of the invention.

Figure 1A:
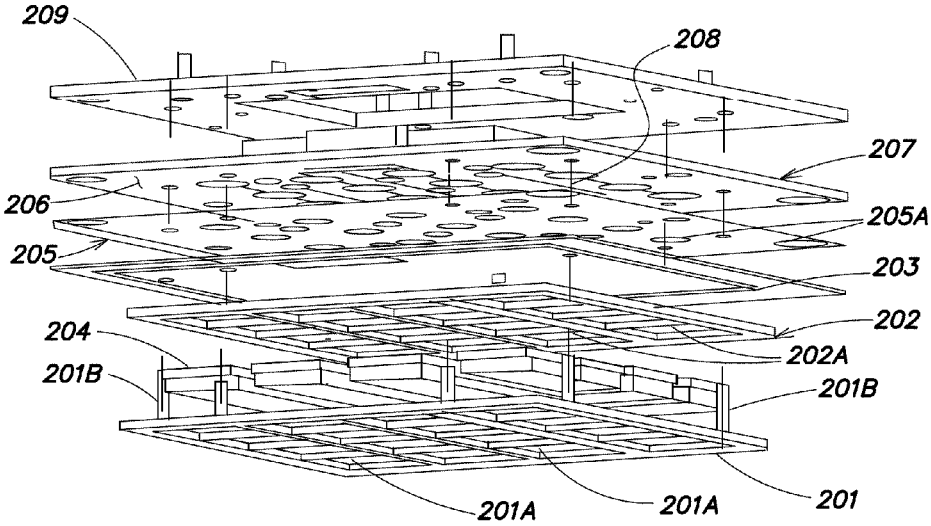
FIG. 1A ( Prior Art )
FIG. 1*a* is a schematic perspective exploded view of a prior art keyboard.
Figure 1B:
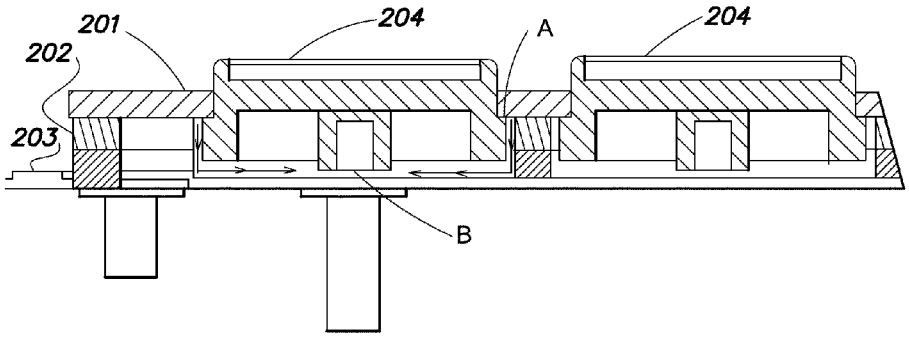
FIG. 1B ( Prior Art )
FIG. 1*b* is a partial structural schematic view of the keyboard shown in FIG. 1*a*.
Figure 2:
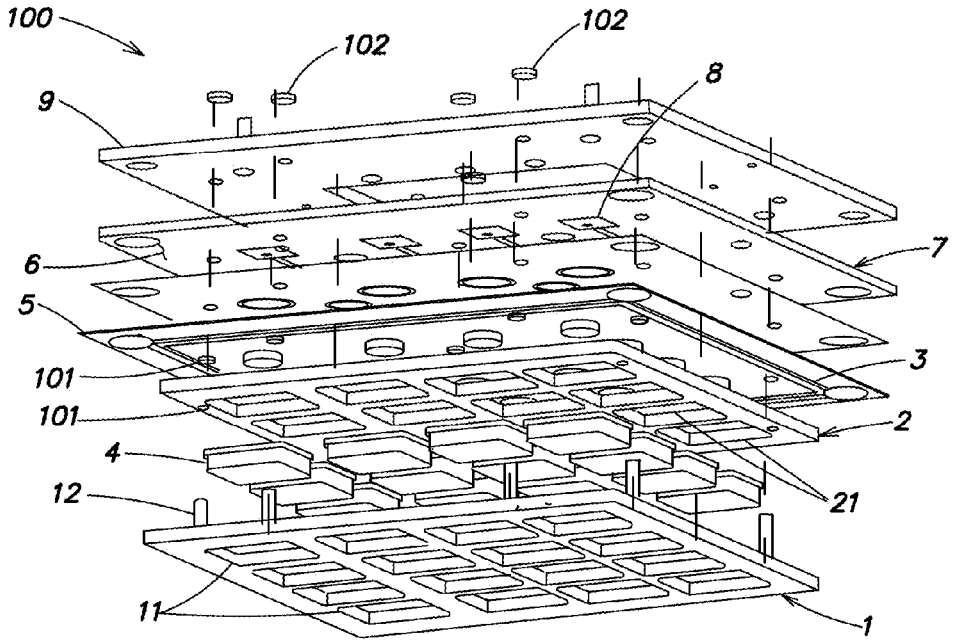
FIG. 2 is a schematic perspective exploded view of one embodiment of a dustproof keyboard according to the invention.

FIG. 2 illustrates one embodiment of the dustproof keyboard of the invention. As shown in FIG. 2, the dustproof keyboard 100 includes a keyboard panel 1, a keyboard liner 2, a waterproof silica gel 3, a binding layer 5, a limiting layer 6, a circuit board 7 and a keyboard soleplate 9, all of which are successively superposed and assembled together. The dustproof keyboard 100 further includes sixteen keyboard keys 4 positioned between the keyboard panel 1 and the keyboard liner 2, and sixteen elastic pieces 8 fixedly positioned between the binding layer 5 and the limiting layer 6.

Specifically, on the keyboard panel 1, eight securing posts 12 are provided. Through the keyboard liner 2, the waterproof silica gel 3, the binding layer 5, the limiting layer 6, the circuit board 7 and the keyboard soleplate 9, eight mounting holes 101 are provided at positions corresponding to the securing posts 12. The securing posts 12 pass through the mounting holes 101 to thereby assemble the keyboard 1, the keyboard liner 2, the waterproof silica gel 3, the binding layer 5, the limiting layer 6, the circuit board 7 and the keyboard soleplate 9 together, and finally to fix them together via nuts 102.

The keyboard panel 1 is provided with sixteen first key slots 11 within which the keyboard keys 4 are embedded correspondingly. The keyboard liner 2 is provided with sixteen second key slots 21 at positions corresponding to the keyboard keys 4. The first 11 and the second 21 key slots provide certain moving spaces for the keyboard keys 4.

Figure 3:
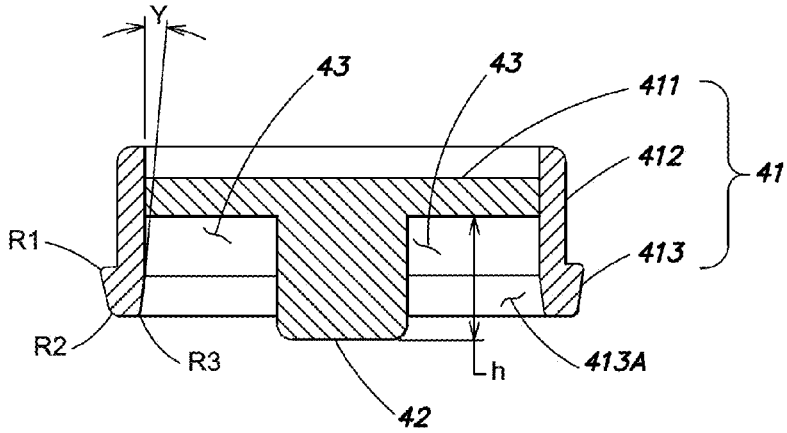
FIG. 3 is a schematic structural view of a keyboard key in the dustproof keyboard as shown in FIG. 2.
Figure 7:
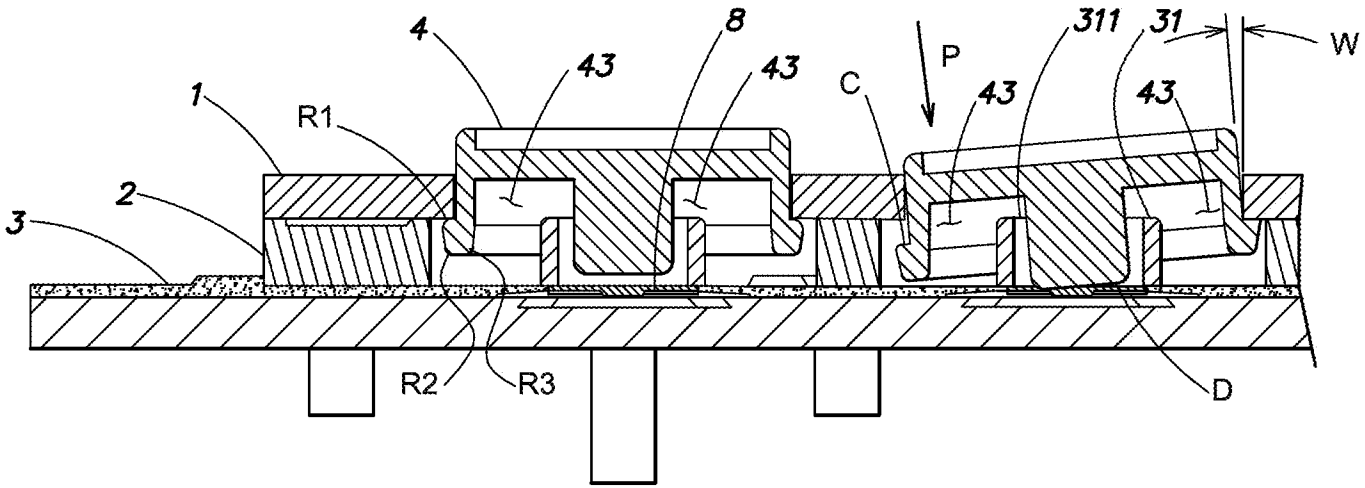
FIG. 7 is a partial schematic sectional view of the dustproof keyboard shown in FIG. 2.

Specifically, as shown in FIG. 3, the keyboard key 4 includes: a keycap 41 including a keycap cover 411, a keycap sidewall 412 and a keycap base 413, wherein the keycap base 413 and the keycap cover 411 are connected to opposite sides of the keycap sidewall 412, respectively, and the keycap base 413 is provided with a through hole 413*a* at a middle portion thereof; and a contact block 42 being connected to a side surface of the keycap cover 411, located within a cavity 43 formed by the keycap cover 411 and the keycap sidewall 412, and protruding out of the through hole 413*a*. With reference to FIG. 7, in the following, a working surface formed at a lower end of the contact block 42 is referred to as working surface D.

The keycap base 413 is projected outwards relative to the keycap sidewall 412, which allows the keyboard key 4 to be caught between the keyboard panel 1 and the keyboard liner 2 so as not to be easily detached. With reference to FIG. 7, in the following, a surface of the keycap base 413 facing the keyboard panel 1 is referred to as securing surface C.

Figure 4:
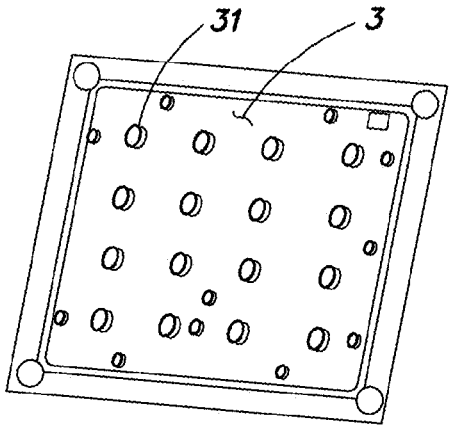
FIG. 4 is a partial exploded view of the dustproof keyboard as shown in FIG. 2.

As shown in FIG. 4, the dustproof keyboard 100 according to the invention further includes dustproof rings 31 each of which is in the form of a hollow post with an opening at one end, and its hollow portion can accommodate the contact block 42. In this embodiment, the hollow posts are ring-like posts. With this configuration, the hollow post has an esthetic appearance and is easy to be produced. The dustproof ring 31 is fixedly positioned on the waterproof silica gel 3 such that the opened end 311 thereof corresponds to the contact block 42 to allow the hollow portion thereof can accommodate the contact block 42.

Specifically, the contact block 42 is a cylinder, and an inner diameter of the dustproof ring 31 is 1.3 times an outer diameter of the contact block 42, while an outer diameter thereof is smaller than a radius of an inscribed circle of a section of the keycap sidewall 412. The contact block 42 freely extends into or retracts out of the dustproof ring 31 within a proper space to ensure a normal key input operation.

Figure 5:
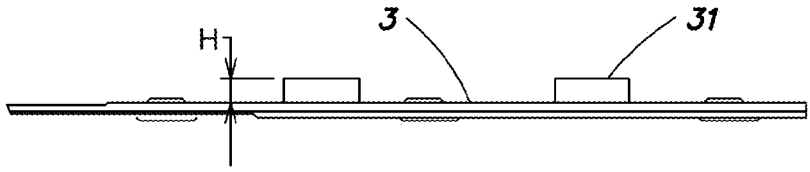
FIG. 5 is a schematic structural view of the portion shown in FIG. 4 viewing from another angle.
Figure 6A:
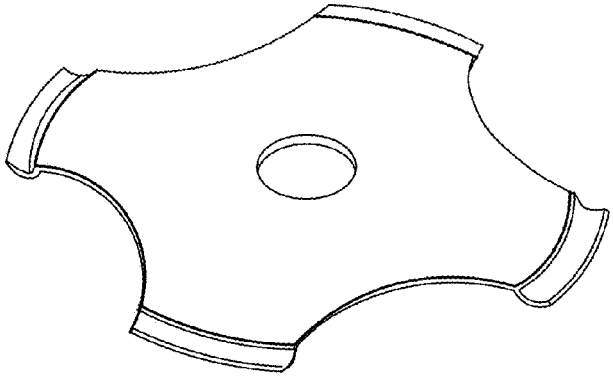
FIG. 6*a* is a schematic structural view of the elastic piece of FIG. 2 viewing from an angle.
Figure 6B:
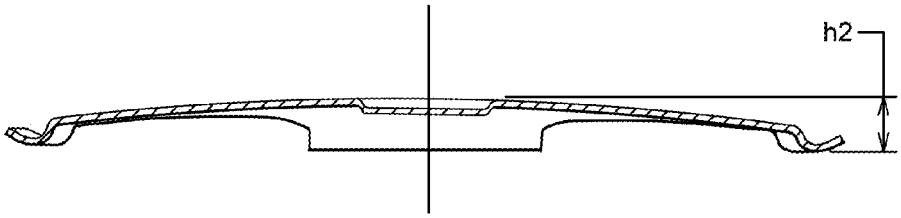
FIG. 6*b* is a schematic structural view of the elastic piece of FIG. 2 viewing from another angle.

With reference to FIG. 5 together with FIGS. 6*b* and 7, a height H of the dustproof ring 31 is greater than a height h2 of the elastic piece 8 and smaller than a length h of the contact block 42, which, during the key operation, can allow the keyboard to be dustproof and waterproof as much as possible, and also can allow for the normal contact between the working surface D of the contact block 42 and the elastic piece 8.

The hollow portion of the dustproof ring 31 can accommodate the contact block 42 and allow it to freely move up and down therewithin without affecting the contact between the working surface D of the contact block 42 and the elastic piece 8. Meanwhile, when the dustproof keyboard 100 is in an operational or standby state, the dust can fall on the waterproof silica gel 3 through a gap between the keyboard panel 1 and the keyboard key 4, and then is guided into the cavity 43. The dustproof ring 31 can separate the working surface D of the contact block 42 from the outside, thus avoiding the entrance of the dust into the working surface D to affect the normal operation of the keys, and thereby avoiding the keys from being blocked due to the entrance of the dust.

With reference to FIG. 7, when the keyboard key 4 is pressed sideways and under an action force in the direction as indicated by arrow P, there is an deviation angle between the real direction in which the keyboard key 4 is pressed and the direction in which it is pressed straight, and the maximum deviation angle is set to be W. In order to maintain the dustproof effect of the keyboard 100 when an deviation angle is formed at the keyboard key 4, as shown in FIG. 3, an inner side wall of the keycap base 413 can be designed to incline outwards in relation to the direction in which the keyboard key 4 is pressed straight, i.e. incline towards the outside of the cavity, thereby creating an inclining angle Y. Preferably, the inclining angle Y can be twice the maximum deviation angle W, thereby more effectively guiding the falling dust to both sides of the cavity 43, avoiding the accumulation of the dust on elastic pieces 8 and achieving a better dustproof function.

As shown in FIG. 3, preferably, a junction between the securing surface C and the outer side wall of the keycap base 413 may be in arc shape, thereby creating a first fillet R1. In the present embodiment, a radius of the first fillet R1 is smaller than 0.5 mm. When the dust falls onto the securing surface C through the gaps between the keyboard keys 4 and the keyboard panel 1, the first fillet R1 can perform a dust-guiding function, thus guiding the falling dust onto the waterproof silica gel 3, avoiding the accumulation of the dust on the securing surface C, avoiding the dust from congesting the gap between the keyboard key 4 and the keyboard panel 1, and thereby avoiding the key from being blocked and being out of control and so on.

As shown in FIG. 3, a junction between the outer side wall of the keycap base 413 and the bottom surface of the keycap 41 can be also in arc shape, thereby creating a second fillet R2. A junction between the inner side wall of the keycap base 413 and the bottom surface of the keycap 41 can be also in arc shape, thereby creating a third fillet R3. In the present embodiment, a radius of the second fillet R2 is the same as that of the third fillet R3, and smaller than 0.5 mm. The falling dust can be guided into the cavity 43 more effectively via the second fillet R2 and the third fillet R3, thereby further preventing the congestion due to the dust, and thus resulting in a more fluent and more comfortable key operation.

In addition, as shown in FIG. 6*a* and FIG. 6*b*, the elastic piece 8 is substantially square with an upward camber, allowing the key operation to have a certain pressing travel, so that the operator feels comfortable.

The limiting layer 6 is a double-faced glue film, the back surface thereof is glued to the circuit board 7 and the front surface thereof is glued with the binding layer 5. The limiting layer 6 is further provided with a plurality of square slots 61 (not shown) for accommodating the corresponding elastic pieces 8 and functioning to limit the elastic pieces 8.

It is to be noted that the dustproof ring 31 may be a cylinder, and may also be other hollow posts. The contact block 42 can be integral with the keycap 41, and can be also fixedly connected thereto in other ways. The keyboard keys 4, the first key slots 11 and the second key slots 21 may be square, and can also be other applicable shapes. The number of the keyboard keys 4 is not limited to sixteen, but can be set to be any other number according to the input requirement. Hence, other components, such as the first key slots 11, the second key slots 21 and the elastic pieces 8, may be all correspondingly adjusted according to the change of the number of the keyboard keys. Moreover, the number of the securing posts 12 can be increased or decreased as required.

The serial number of the above embodiments is only for illustration, but not representative of the merit of the embodiments. The invention is described above with reference to the optimal embodiments, however, the invention is not limited to the above disclosed embodiments, but should be construed as covering various modifications and equivalent combinations made according to the spirit of the invention.

What is claimed is:

1. A dustproof keyboard, comprising a keyboard main body and at least one keyboard key disposed at the keyboard main body so as to be caught therein, the keyboard key comprising a keycap and a contact block connected to a side of the keycap, the keyboard main body comprising a binding layer, a silica gel layer disposed between the binding layer and the keyboard key, a circuit board, and elastic pieces corresponding to the keyboard keys and disposed between the binding layer and the circuit board, wherein in correspondence to the elastic pieces, a plurality of dustproof rings are provided on the silica gel layer, each of the dustproof rings being a hollow post with at least one end being opened, and the opened end thereof being exactly towards the contact block;

wherein the dustproof ring is a ring-like post;

the keycap comprises a keycap cover, a keycap sidewall and a keycap base provided with a through hole in a middle portion thereof, the keycap base and the keycap cover being connected to opposite sides of the keycap sidewall respectively, and the contact block being located within a cavity formed by the keycap cover and the keycap sidewall; and the contact block is a cylinder, an inner diameter of the dustproof ring being 1.3 times an outer diameter of the contact block, and an outer diameter thereof being smaller than a radius of an inscribed circle of the section of the keycap sidewall.

2. The dustproof keyboard according to claim 1, wherein a height of the dustproof ring is greater than a height of the elastic piece and smaller than a length of the contact block.

3. The dustproof keyboard according to claim 2, wherein an inner side wall of the keycap base is inclined outwards in relation to a direction in which the keyboard key is pressed straight.

4. The dustproof keyboard according to claim 3, wherein an included angle between the inner side wall of the keycap base and the straight pressing direction of the keyboard key is twice a maximum deviation angle of the key.

5. The dustproof keyboard according to claim 3, wherein at least one junction between two adjacent surfaces of the keycap base is in arc shape.

6. The dustproof keyboard according to claim 5, wherein a radius of the arc is smaller than 0.5 mm.

7. The dustproof keyboard according to claim 1, wherein an inner side wall of the keycap base is inclined outwards in relation to a direction in which the keyboard key is pressed straight.

8. The dustproof keyboard according to claim 7, wherein an included angle between the inner side wall of the keycap base and the straight pressing direction of the keyboard key is twice a maximum deviation angle of the key.

9. The dustproof keyboard according to claim 7, wherein at least one junction between two adjacent surfaces of the keycap base is in arc shape.

10. The dustproof keyboard according to claim 9, wherein a radius of the arc is smaller than 0.5 mm.

11. The dustproof keyboard according to claim 1, wherein an inner side wall of the keycap base is inclined outwards in relation to a direction in which the keyboard key is pressed straight.

12. The dustproof keyboard according to claim 11, wherein an included angle between the inner side wall of the keycap base and the straight pressing direction of the keyboard key is twice a maximum deviation angle of the key.

13. The dustproof keyboard according to claim 11, wherein at least one junction between two adjacent surfaces of the keycap base is in arc shape.

14. The dustproof keyboard according to claim 13, wherein a radius of the arc is smaller than 0.5 mm.

* * * * *